US009408449B1

(12) United States Patent
Tsai

(10) Patent No.: US 9,408,449 B1
(45) Date of Patent: Aug. 9, 2016

(54) STEPLESS RETRACTABLE HANDLE ASSEMBLY FOR LUGGAGE

(71) Applicant: HOKEI CORPORATION, Taichung (TW)

(72) Inventor: James Tsai, Taichung (TW)

(73) Assignee: HOKEI CORPORATION, Taichung (TW)

( * ) Notice: Subject to any disclaimer, the term of this patent is extended or adjusted under 35 U.S.C. 154(b) by 71 days.

(21) Appl. No.: 14/597,687

(22) Filed: Jan. 15, 2015

(51) Int. Cl.
*A45C 13/26* (2006.01)

(52) U.S. Cl.
CPC ..... *A45C 13/262* (2013.01); *A45C 13/26* (2013.01); *A45C 2013/267* (2013.01); *Y10T 16/451* (2015.01); *Y10T 16/473* (2015.01)

(58) Field of Classification Search
CPC ..... A45C 13/26; A45C 13/262; A45C 2013/267; Y10T 16/451; Y10T 16/473
See application file for complete search history.

(56) References Cited

U.S. PATENT DOCUMENTS 5,488,756 A * 2/1996 Hsieh ..... A45C 13/262 16/113.1
5,519,919 A * 5/1996 Lee ..... B62B 1/147 16/113.1
5,570,491 A * 11/1996 Tung ..... A45C 13/262 16/113.1
5,806,143 A * 9/1998 Tsai ..... A45C 13/262 16/405
5,909,760 A * 6/1999 Tsai ..... A45C 13/262 16/429
6,026,542 A * 2/2000 Lu ..... A45C 13/262 16/113.1
6,122,800 A * 9/2000 Cheng ..... A45C 13/262 16/113.1
6,170,122 B1 * 1/2001 Kuo ..... A45C 13/262 16/405
6,357,080 B1 * 3/2002 Tsai ..... A45C 13/262 16/113.1
6,374,457 B1 * 4/2002 Kuo ..... A45C 13/262 16/113.1
6,497,311 B2 * 12/2002 Tiramani ..... A45C 3/001 16/113.1
6,581,737 B2 * 6/2003 Wang ..... B25B 9/00 16/113.1
6,898,823 B2 * 5/2005 Tsai ..... A45C 13/262 16/113.1
7,165,661 B2 * 1/2007 Miyoshi ..... A45C 13/262 16/113.1
7,266,863 B2 * 9/2007 Lu ..... A45C 13/262 16/113.1
7,658,269 B2 * 2/2010 Wu ..... A45C 13/262 16/113.1
8,132,289 B2 * 3/2012 Hahn ..... A45C 13/262 15/144.4
8,474,098 B1 * 7/2013 Yang ..... A45C 13/262 16/113.1
8,726,464 B1 * 5/2014 Tong ..... A45C 13/262 16/113.1
2005/0067245 A1 * 3/2005 Tsai ..... A45C 13/262 190/115
2008/0078053 A1 * 4/2008 Lu ..... A45C 13/262 16/113.1
2012/0205510 A1 * 8/2012 Fortier ..... A45C 13/262 248/423
2014/0137370 A1 * 5/2014 Lo ..... A45C 13/262 16/113.1
2015/0208779 A1 * 7/2015 Tong ..... A45C 13/26 16/113.1

* cited by examiner

*Primary Examiner* — Jeffrey O Brien
(74) *Attorney, Agent, or Firm* — Muncy, Geissler, Olds & Lowe, P.C.

(57) ABSTRACT

A stepless retractable handle assembly for luggage includes a handle grip and two retractable bars connected to the handle grip in such a manner that when pressed a press-button in the handle grip, two transmission plates in the handle grip are forced by the press-button to move transversely in reverse directions, and two connection shafts are forced by the transmission plates to move vertically in the respective retractable bars in biasing respective anchor clamps away from the inside walls of the outer tubes of the respective retractable bars for allowing adjustment of the height of respective inner tubes of the retractable bars. When released the press-button after the adjustment, the anchor clamps are returned to abut against the inside walls of the respective outer tubes, locking the inner tubes in the adjusted position.

9 Claims, 9 Drawing Sheets

STEPLESS RETRACTABLE HANDLE ASSEMBLY FOR LUGGAGE

BACKGROUND OF THE INVENTION

1. Field of the Invention

The present invention relates to luggage technology, and more particularly, to a stepless retractable handle assembly for luggage.

2. Description of the Related Art

A luggage normally has rollers mounted at the bottom side thereof, and a retractable handle mounted at the back side thereof. By means of the rotation of the rollers and the draggable function of the retractable handle, the carrying convenience of the luggage is enhanced.

For enabling a luggage to be dragged with less effort, conventional retractable handles are commonly made in a multi-stage telescopic design. In the retractable handle adjustment process, it needs the help of positioning pins, positioning steel balls or other positioning structures to achieve the desired positioning effect. However, these positioning structures likely to cause a limitation in the adjustment process, making the user unable to adjust the retractable handle to the most appropriate height according to the actual needs. This will also affect the comfort of the use of the retractable handle with luggage.

SUMMARY OF THE INVENTION

The present invention has been accomplished under the circumstances in view. It is the main object of the present invention to provide a stepless retractable handle assembly for luggage, which is quite convenient in operation and allows adjustment to any desired height without structural limitations.

To achieve this and other objects of the present invention, a stepless retractable handle assembly for luggage comprises a handle grip, two retractable bars, a control unit, a transmission unit, and two positioning units. The handle grip comprises a bottom grip shell, and a top grip shell mounted on a top side of the bottom grip shell. The top grip shell comprises a button slot. Each retractable bar comprises an outer tube and an inner tube axially slidably inserted into the outer tube. The inner tube has a top end thereof fixedly connected to the bottom grip shell of the handle grip, and thus, the two inner tubes can be carried by the handle grip to move in the respective outer tubes up and down. The control unit comprises a press-button and a first teturn device. The press-button is vertically movably mounted in the button slot of the top grip shell of the handle grip, comprising two first pushing abutment portions located at a bottom side thereof. The first teturn device is mounted between the bottom grip shell of the handle grip and the press-button to impart an elastic restoring force to the press-button. The transmission unit comprises two transmission plates, two bearing blocks, and two connection shafts. The two transmission plates are transversely movably mounted in the bottom grip shell of the handle grip, each comprising two first bearing portions located at one end thereof and respectively abutted against the first pushing abutment portions of the press-button and a second pushing abutment portion located at an opposite end thereof. Thus, the two transmission plates can be moved transversely when the press-button is pressed by an external force. The two bearing blocks are respectively affixed to respective top ends of the inner tubes of the retractable bars, each comprising a second bearing portion abutted against the second pushing abutment portion of one respective transmission plate. The two connection shafts are respectively inserted into the inner tubes of the retractable bars, and respectively connected to respective bottom ends of the bearing blocks. Thus, the bearing blocks are drivable to move the connected connection shafts vertically. Each positioning unit is mounted in one respective retractable bar, comprising an anchor clamp holder, an anchor clamp and a second teturn device. The anchor clamp holder is mounted in the inner tube of one respective retractable bar and connected to a bottom end of one respective connection shaft for movement with the inner tube of the respective retractable bar relative to the associating outer tube. The anchor clamp is pivotally connected to the anchor clamp holder and disposed in the outer tube of the respective retractable bar and movable to abut against or release from an inside wall of the outer tube of the respective retractable bar subject to vertical displacement of the anchor clamp holder in the respective retractable bar. The second teturn device is stopped against the anchor clamp holder to impart an elastic restoring forced to the anchor clamp holder. Thus, when pressed on the press-button, the anchor clamps are released from the inside walls of the outer tubes of the respective retractable bars for allowing adjustment of the height of the inner tubes of the retractable bars. When released the press-button, the anchor clamps are extended out to abut against the inside walls of the outer tubes of the respective retractable bars, locking the inner tubes of the retractable bars in the adjusted position.

Preferably, the movable holder frame of the anchor clamp holder comprises a first lateral hole and a second lateral hole; the anchor clamp comprises a first clamping arm and a second clamping arm. The first clamping arm comprises a first transverse guide hole located in one end thereof, and a first pivot hole disposed adjacent to the first transverse guide hole. The second clamping arm comprises a second transverse guide hole located in one end thereof, and a second pivot hole disposed adjacent to the second transverse guide hole. Each positioning unit further comprises a first pivot bolt and a second pivot bolt. The first pivot bolt is inserted through the first lateral hole of the respective movable holder frame and the first transverse guide hole of the respective first clamping arm. The second pivot bolt is inserted through the second lateral hole of the respective movable holder frame and the second transverse guide hole of the respective second clamping arm. Thus, the first and second clamping arms of the anchor clamp can be biased to abut against or release from the inside wall of the outer tube of the respective retractable bar when the respective movable holder frame is moved vertically.

Preferably, each positioning unit further comprises a supplementary anchor clamp pivotally connected the bottom end of the respective movable holder frame below the associating anchor clamp. Thus, the supplementary anchor clamp can be biased to abut against or release from the inside wall of the outer tube of the respective retractable bar when the associating movable holder frame is moved vertically, enhancing the functioning of the respective positioning unit to lock the inner tube of the respective retractable bar.

Other advantages and features of the present invention will be fully understood by reference to the following specification in conjunction with the accompanying drawings, in which like reference signs denote like components of structure.

DETAILED DESCRIPTION OF THE INVENTION

Figure 1:
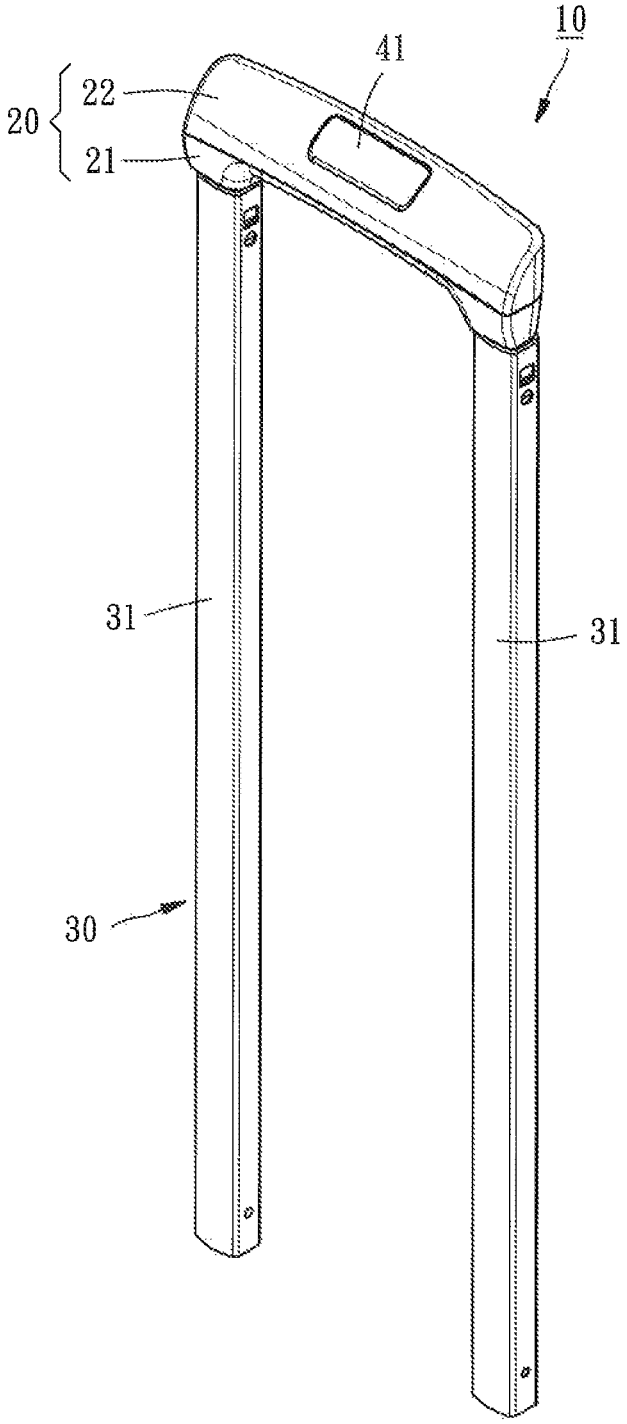
FIG. 1 is an oblique top elevational view of a stepless retractable handle assembly for luggage in accordance with a first embodiment of the present invention.

Referring to FIGS. 1, 2, 3 and 5, a stepless retractable handle assembly 10 for luggage in accordance with a first embodiment of the present invention is shown. The c stepless retractable handle assembly 10 comprises a handle grip 20, two retractable bars 30, a control unit 40, a transmission unit 50, and two positioning units 60.

The handle grip 20 comprises a bottom grip shell 21, and a top grip shell 22 affixed to a top side of the bottom grip shell 21. The top grip shell 22 defines therein a button slot 23.

Figure 3:
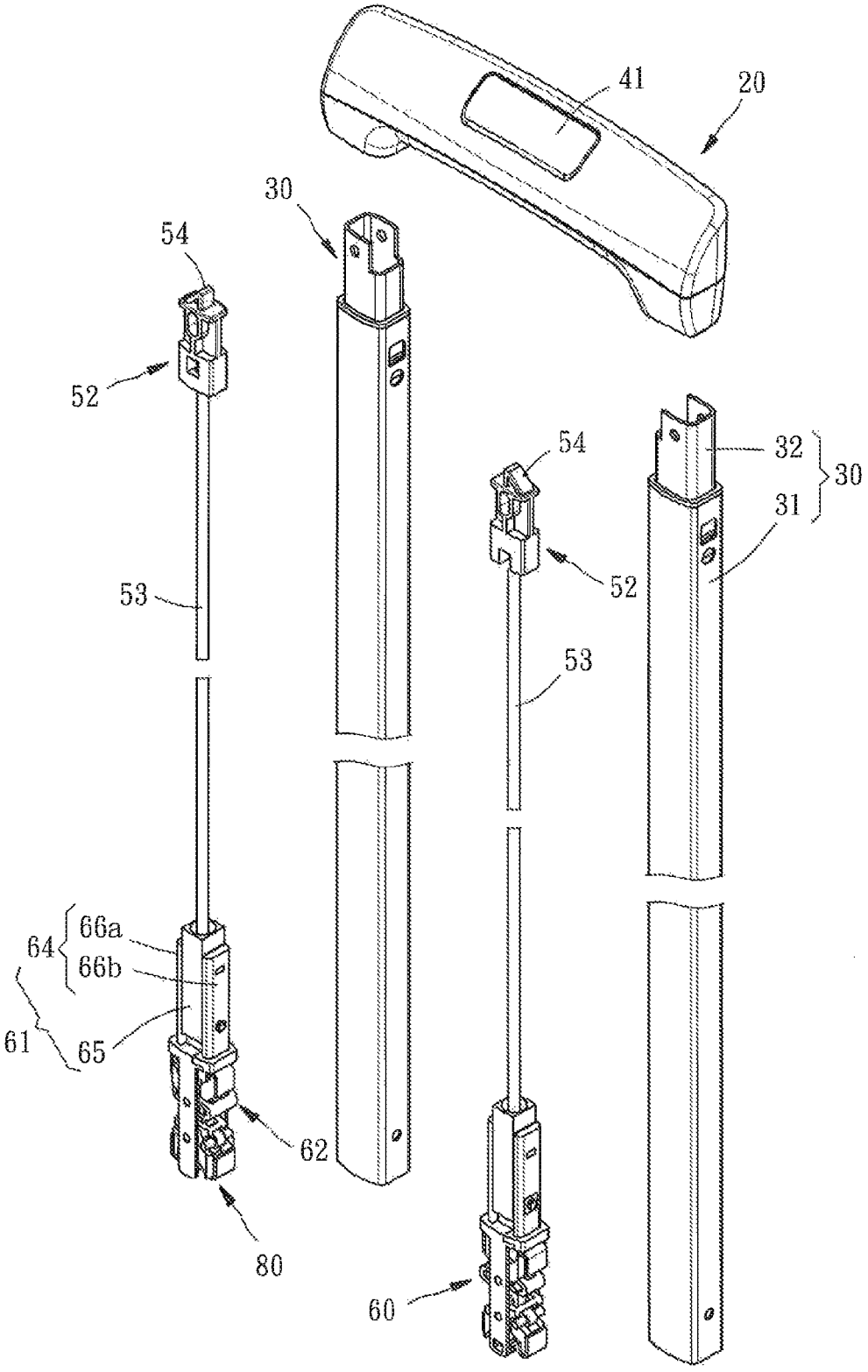
FIG. 3 is another partial exploded view of the stepless retractable handle assembly for luggage in accordance with the first embodiment of the present invention.
Figure 5:
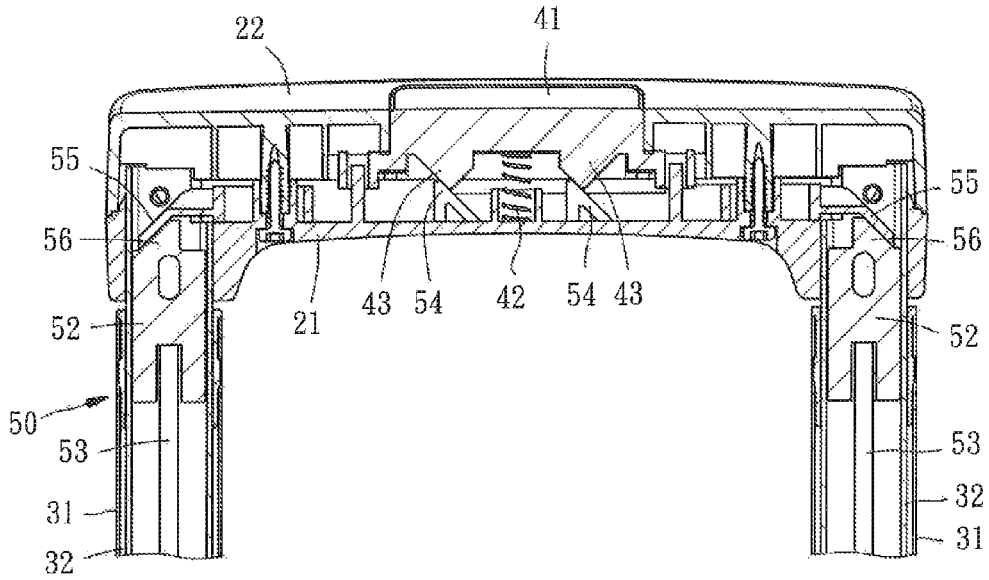
FIG. 5 is a sectional view of a part of the first embodiment of the present invention, illustrating the internal arrangement of the handle grip before pressing of the press-button.

Each retractable bar 30 comprises an outer tube 31, and an inner tube 32 slidably axially inserted into the outer tube 31. As shown in FIG. 3 and FIG. 5, the outer tube 31 has a bottom end thereof affixed to a luggage (not shown), and an opposing top end thereof affixed to the bottom grip shell 21 of the handle grip 20. Thus, the inner tube 32 is movable with the handle grip 20 up and down relative to the outer tube 31.

Figure 2:
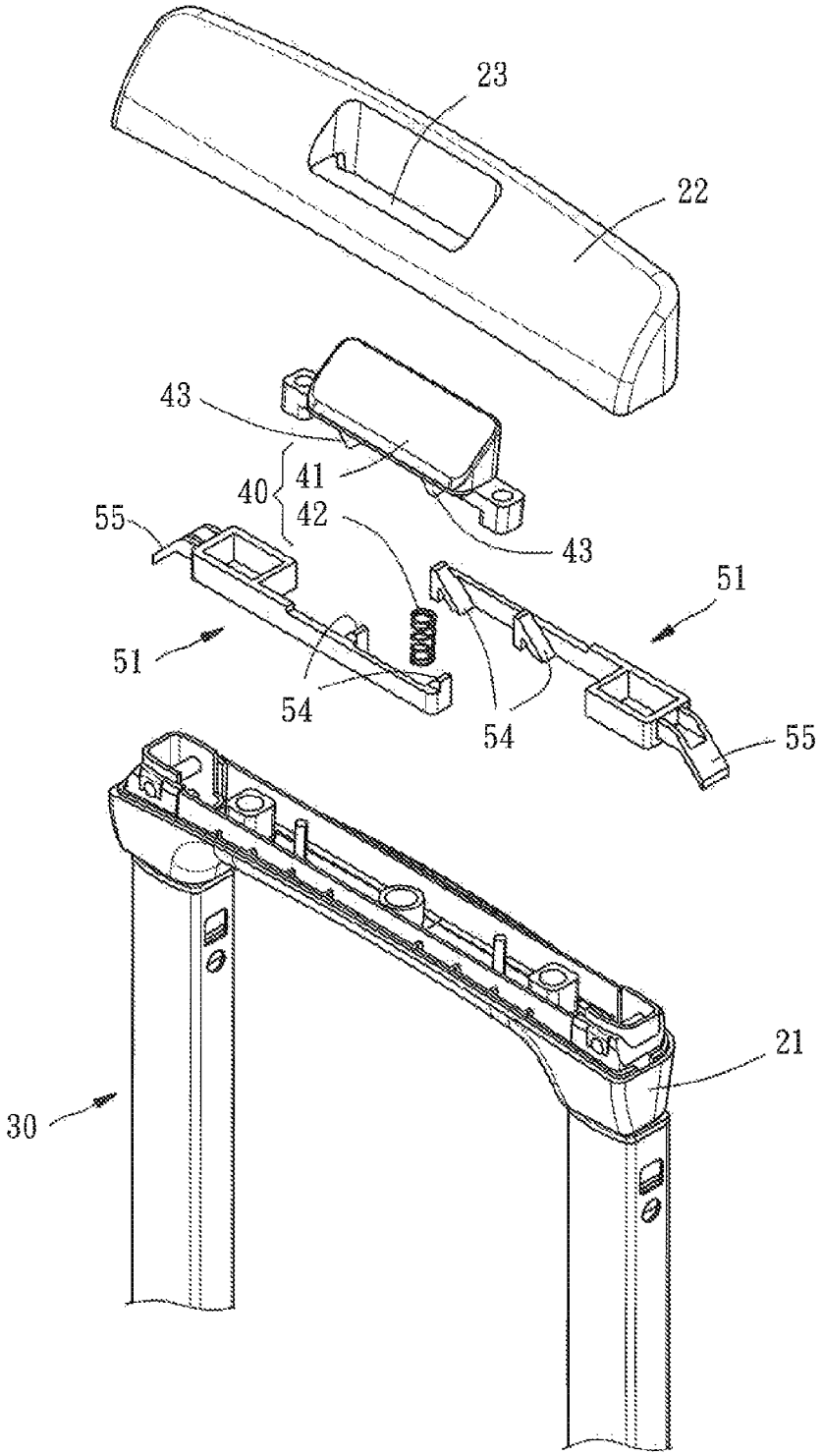
FIG. 2 is a partial exploded view of the stepless retractable handle assembly for luggage in accordance with the first embodiment of the present invention.

The control unit 40 comprises a press-button 41 and a first teturn device 42. As illustrated in FIG. 2 and FIG. 5, the press-button 41 is mounted in the button slot 23 of the top grip shell 22 of the handle grip 20. Further, the press-button 41 has two first pushing abutment portions 43 spaced at a bottom side thereof. The first teturn device 42 (for example, compression spring) is mounted between the bottom grip shell 21 and the press-button 41, and adapted to provide an upward elastic restoring force to the press-button 41.

Referring to FIGS. 2 and 5 again, the transmission unit 50 comprises two transmission plates 51, two bearing blocks 52, and two connection shafts 53. The two transmission plates 51 are symmetrically mounted in the bottom grip shell 21 of the handle grip 20 at two opposite sides, each having one end thereof provided with two spaced first bearing portions 54 respectively abutted against the first pushing abutment portions 43 of the press-button 41 of the control unit 40 and an opposite end thereof provided with a second pushing abutment portion 55. The bearing blocks 52 are respectively fixedly mounted at respective top ends of the inner tubes 32 of the retractable bars 30, each comprising a second bearing portion 56 abutted against the second pushing abutment portion 55 of the second pushing abutment portion 55 of one respective transmission plate 51. The connection shafts 53 are respectively inserted into the inner tubes 32 of the retractable bars 30, each having a top end thereof fixedly connected to a bottom side of one respective bearing block 52.

Figure 4:
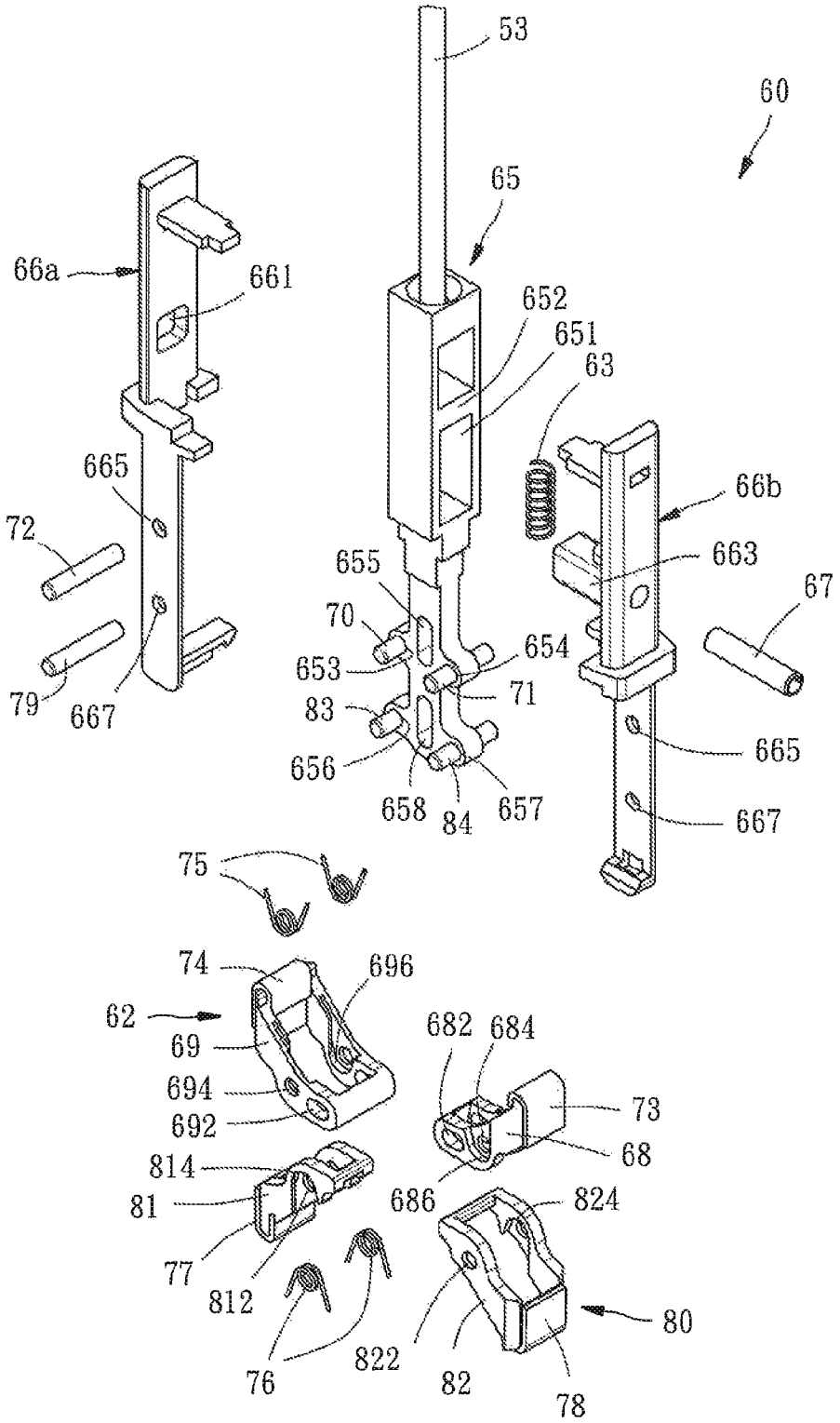
FIG. 4 is an exploded view of one positioning unit of the stepless retractable handle assembly for luggage in accordance with the first embodiment of the present invention.

Referring to FIG. 4 and FIG. 3 again, each positioning unit 60 comprises an anchor clamp holder 61, an anchor clamp 62, and a second teturn device 63. The anchor clamp holder 61 comprises a fixed holder frame 64 and a movable holder frame 65. The fixed holder frame 64 consists of a first frame half **66*a* and a second frame half 66*b*. The first frame half 66*a* comprises a mounting hole 661 located in an upper part thereof. The second frame half 66*b* comprises a lower bearing wall 663 located at an upper part thereof. The first frame half 66*a* and the second frame half 66*b* are assembled together by plugging the lower bearing wall 663 into the mounting hole 661. Further, the first frame half 66*a* and the second frame half 66*b* are affixed to a bottom end of the inner tube 32 of one respective retractable bar 30 with a plug pin 67 that is inserted into the lower bearing wall 663 of the second frame half 66*b* (see FIG. 7). Further, the two frame halves 66*a*;66*b* each have a first locating hole 665 located in a lower part thereof and a second locating hole 667 spaced below the first locating hole 665. The movable holder frame 65 comprises an opening 651 located in an upper part thereof, and an upper bearing wall 652 located in the opening 651. The lower bearing wall 663 of the second frame half 66*b* is inserted through the opening 651 so that the movable holder frame 65 is kept between the first and second frame halves 66*a*;66*b* of the fixed holder frame 64. The movable holder frame 65 further comprises opposing first lateral hole 653 and second lateral hole 654 located in a lower part thereof, a first longitudinal sliding slot 655 spaced between the first lateral hole 653 and the second lateral hole 654, a third lateral hole 656 spaced below the first lateral hole 653, a fourth lateral hole 657 spaced below the second lateral hole 654, and a second longitudinal sliding slot 658 spaced between the third lateral hole 656 and the fourth lateral hole 657**.

The anchor clamp 62 comprises a first clamping arm 68. The first clamping arm 68 comprises a first transverse guide hole 682 extended through two opposite lateral sides of one end thereof, and a first pivot hole 684 disposed adjacent to the first transverse guide hole 682. The first clamping arm 68 is pivotally connected to a bottom end of the movable holder frame 65 with a first pivot bolt 70. The first pivot bolt 70 is inserted through the first lateral hole 653 of the movable holder frame 65 and the first transverse guide hole 682 of the first clamping arm 68. The anchor clamp 62 further comprises a second clamping arm 69. The second clamping arm 69 comprises a second transverse guide hole 692 extended through two opposite lateral sides of one end thereof, and a second pivot hole 694 disposed adjacent to the second transverse guide hole 692. The second clamping arm 69 is pivotally connected to the bottom end of the movable holder frame 65 with a second pivot bolt 71. The second pivot bolt 71 is inserted through the second lateral hole 654 of the movable holder frame 65 and the second transverse guide hole 692 of the second clamping arm 69. Further, the first clamping arm 68 and the second clamping arm 69 are pivotally connected together by a first pivot pin 72. The first pivot pin 72 is inserted through the first locating hole 665 of the fixed holder frame 64, the first pivot hole 684 of the first clamping arm 68, the second pivot hole 694 of the second clamping arm 69 and the first longitudinal sliding slot 655 of the movable holder frame 65. The anchor clamp 62 further comprises a first friction member 73 and a second friction member 74. The first friction member 73 is mounted at an opposite end of the first clamping arm 68. The second friction member 74 is mounted at an opposite end of the second clamping arm 69. The second teturn device 63 (for example, compression spring) is mounted in the opening 651 of the movable holder frame 65 and stopped between the lower bearing wall 663 of the fixed holder frame 64 and the upper bearing wall 652 of the movable holder frame 65 to impart an upward pressure to the movable holder frame 65.

Each positioning unit 60 further comprises two first torsion springs 75. The first torsion springs 75 are respectively mounted on two opposite ends of the first pivot pin 72 and respectively accommodated in a first spring groove 686 in the first clamping arm 68 and a second spring groove 696 in the second clamping arm 69. The first spring groove 686 extends around the first pivot hole 684. The second spring groove 696 extends around the second pivot hole 694. Thus, the first torsion springs 75 can simultaneously impart an outward elastic restoring force to the first and second clamping arm 68;69.

Each positioning unit 60 further comprises a supplementary anchor clamp 80. The supplementary anchor clamp 80 comprises a third clamping arm 81, a third friction member 77, a fourth clamping arm 82, and a fourth friction member 78. The third clamping arm 81 has a third pivot hole 812 extended through two opposite lateral sides of one end thereof. The third friction member 77 is mounted at an opposite end of the third clamping arm 81. The fourth clamping arm 82 has a fourth pivot hole 822 extended through two opposite lateral sides of one end thereof. The fourth friction member 78 is mounted at an opposite end of the fourth clamping arm 82. The third clamping arm 81 and the fourth clamping arm 82 are pivotally connected to the bottom end of the movable holder frame 65 by a second pivot pin 79. The second pivot pin 79 is inserted through the second locating hole 667 of the fixed holder frame 64, the third pivot hole 812 of the third clamping arm 81, the fourth pivot hole 822 of the fourth clamping arm 82 and the second longitudinal sliding slot 658 of the movable holder frame 65. Each positioning unit 60 further comprises a third pivot bolt 83, a fourth pivot bolt 84, and two second torsion springs 76. The third pivot bolt 83 is inserted into the third lateral hole 656 of the movable holder frame 65 and stopped at the outer perimeter of the third clamping arm 81. The fourth pivot bolt 84 is inserted into the fourth lateral hole 657 of the movable holder frame 65 and stopped at the outer perimeter of the fourth clamping arm 82. The two second torsion springs 76 are respectively mounted on two opposite ends of the second pivot pin 79 and respectively accommodated in a third spring groove 814 in the third clamping arm 81 and a fourth spring groove 824 in the fourth clamping arm 82. The third spring groove 814 extends around the third pivot hole 812. The fourth spring groove 824 extends around the fourth pivot hole 822. Thus, the second torsion springs 76 can simultaneously impart an outward elastic restoring force to the third and fourth clamping arm 81;82.

Figure 6:
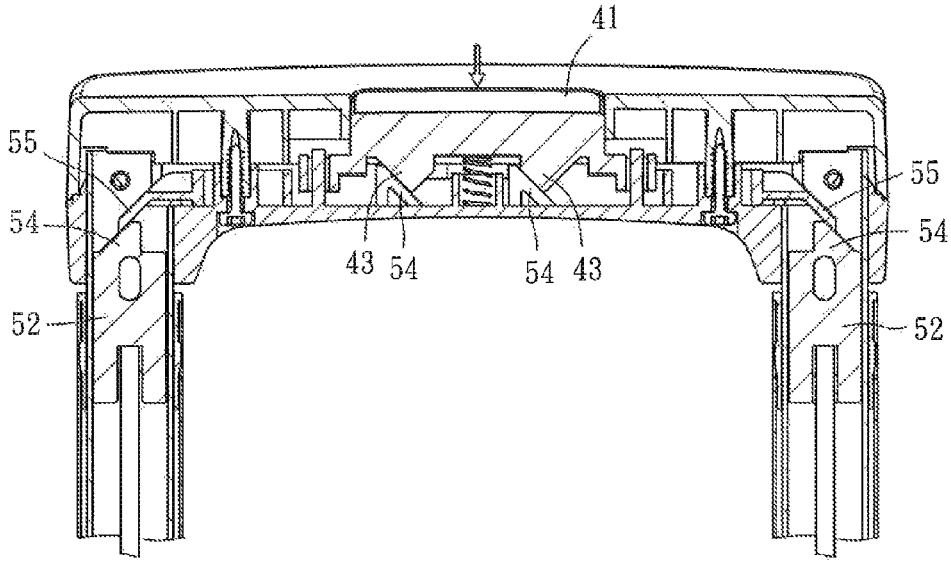
FIG. 6 is similar to FIG. 5, illustrating the press-button pressed.
Figure 8:
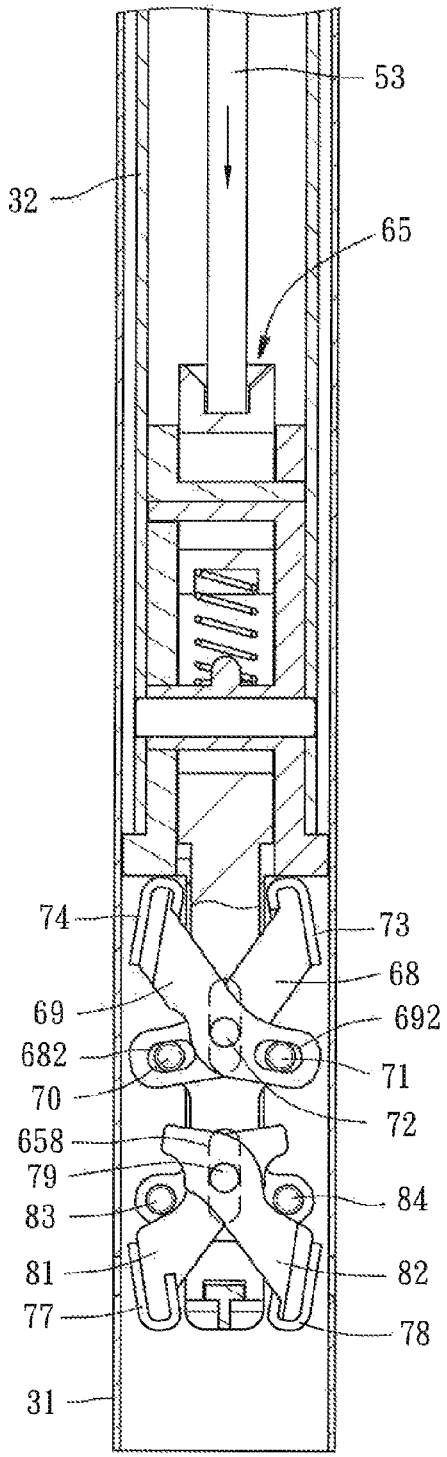
FIG. 8 is similar to FIG. 7, illustrating the anchor clamp and the supplementary anchor clamp released from the inside wall of the outer tube of the associating retractable bar.
Figure 9:
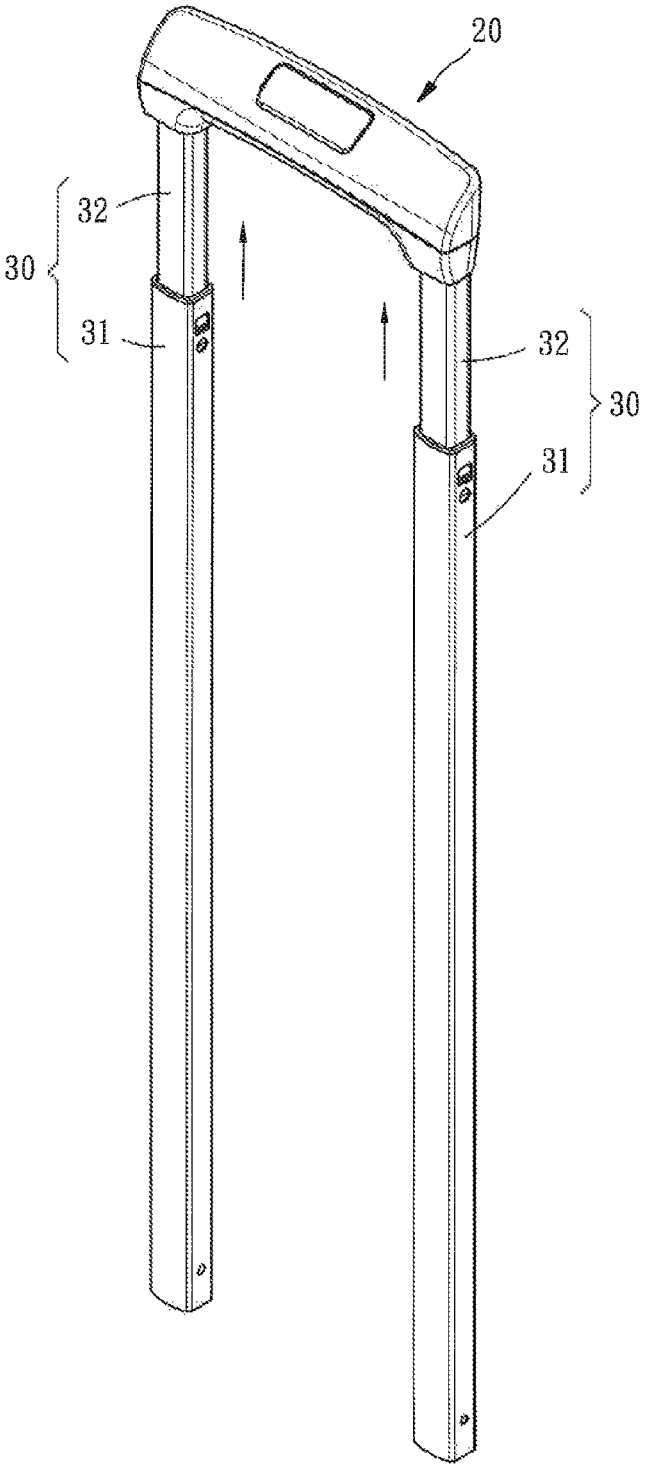
FIG. 9 is similar to FIG. 1, illustrating the height of the inner tubes of the retractable bars adjusted.

Thus, when going to adjust the height of the retractable bars 30, press on the press-button 41, as illustrated in FIG. 6. At this time, the first pushing abutment portion 43 of the press-button 41 is forced to push the first bearing portions 54 of the transmission plates 51, moving the transmission plates 51 transversely in two reversed directions away from the press-button 41. During transverse movement of the transmission plates 51, the second pushing abutment portions 55 of the transmission plates 51 will be forced to push the second bearing portions 56 of the respective bearing blocks 52, moving the bearing blocks 52 and the respective connection shafts 53 downwards. During downward movement of the connection shafts 53, the connected movable holder frames 65 are lowered with the respective connection shafts 53, as shown in FIG. 8. When the movable holder frames 65 are being lowered, the first and second pivot bolts 70;71 are respectively forced to downwardly move the hole wall of the first transverse guide hole 682 of the first clamping arm 68 and the hole wall of the second transverse guide hole 692 of the second clamping arm 69, causing the first and second clamping arms 68;69 of the anchor clamp 62 of each positioning unit 60 to turn about the associating first pivot pin 72. At this time, the first and second friction members 73;74 of the anchor clamp 62 of each positioning unit 60 are moved away from the inside wall of the outer tube 31 of the associating retractable bar 30. On the other hand, during downward movement of the movable holder frames 65, the respective third and fourth pivot bolts 83;84 are forced to downwardly move the respective third clamping arms 81 and the respective fourth clamping arms 82, causing the third and fourth clamping arms 81;82 of the supplementary anchor clamp 80 to inwardly turn about the pivot pin 79, as shown in FIG. 8. At this time, the third and fourth friction members 77;78 are moved away from the inside wall of the outer tube 31 of the associating retractable bar 30. Thus, as shown in FIG. 9, the user can pull the handle grip 20 to move the inner tubes 32 of the retractable bars 30 relative to the respective outer tubes 31, thereby adjusting the retractable bars 30 to the desired height.

Figure 7:
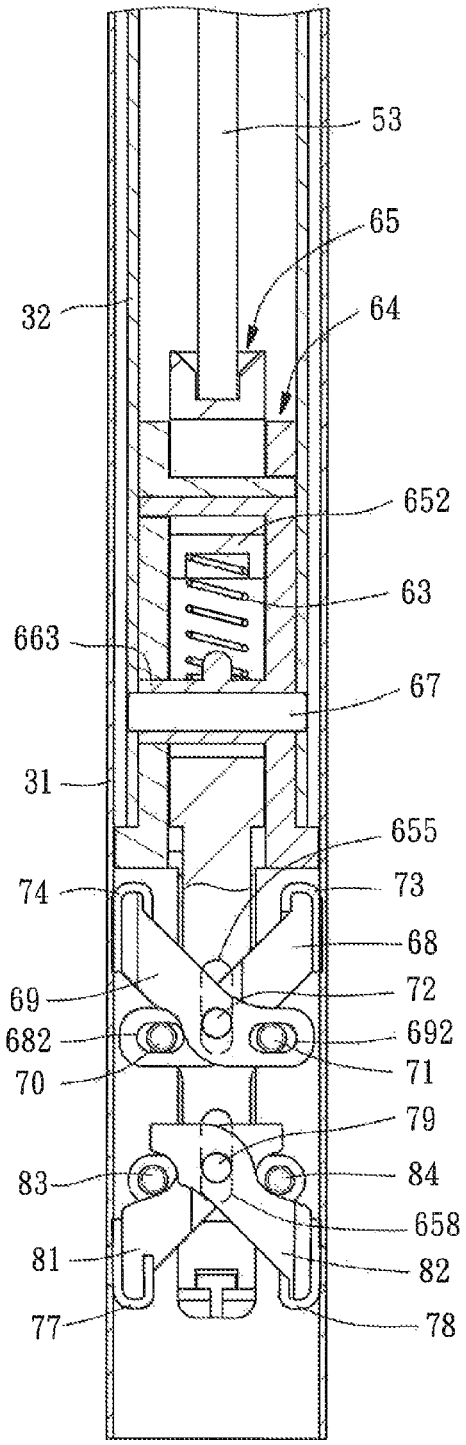
FIG. 7 is a sectional view of a part of the first embodiment of the present invention, illustrating the anchor clamp and the supplementary anchor clamp abutted against the inside wall of the outer tube of the associating retractable bar.

After the retractable bars 30 are adjusted to the desired height, release the pressure from the press-button 41, allowing the press-button 41 to be returned to its former position by the elastic restoring force of the first teturn device 42, as shown in FIG. 5. After the press-button 41 returned to its former position, the transmission plates 51 are released from the pressure of the press-button 41. At this time, the movable holder frames 65 are moved upwards by the respective second teturn devices 63. During upward movement of the movable holder frames 65, the connection shafts 53 are carried upwards by the respective movable holder frames 65. During upward movement of the connection shafts 53, the respective bearing blocks 52 are forced to move the respective transmission plates 51, thereby returning the respective transmission plates 51 to their former position. Further, during upward movement of the movable holder frames 65, the respective first and second pivot bolts 70;71 are released from the respective first and second clamping arms 68;69, allowing the respective first and second clamping arms 68;69 to be respectively forced outwards by the respective first torsion springs 75 to abut the respective first and second friction members 73;74 against the inside walls of the outer tubes 31 of the respective retractable bars 30. At the same time, the respective third and fourth pivot bolts 83;84 are released from the associating third and fourth clamping arms 81;82, allowing the respective third and fourth clamping arms 81;82 to be respectively forced outwards by the respective second torsion springs 76 to abut the respective third and fourth friction members 77;78 against the inside walls of the outer tubes 31 of the respective retractable bars 30, as shown in FIG. 7, thereby locking the inner tubes 32 to the respective outer tubes 31.

Figure 10:
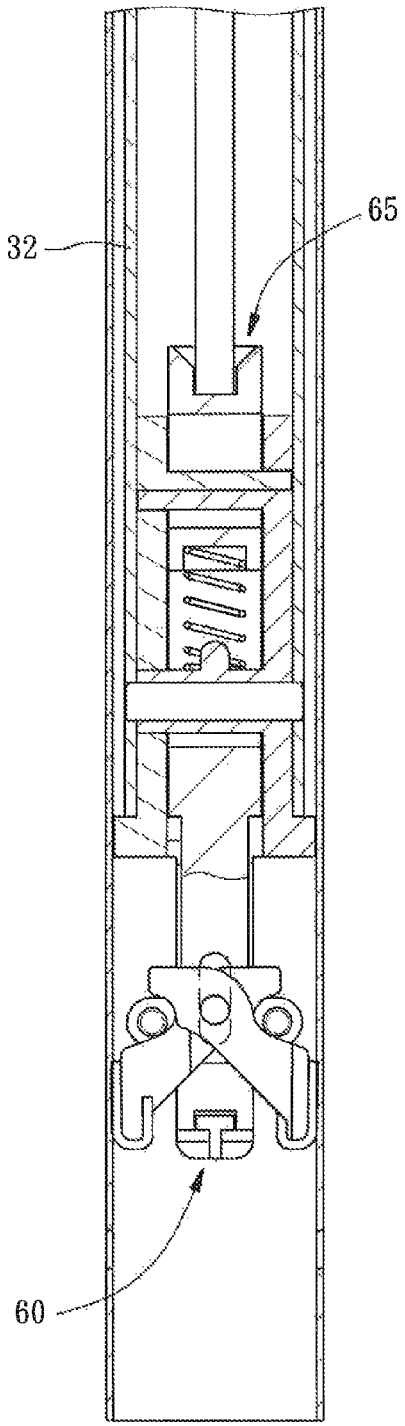
FIG. 10 is a sectional view of one retractable bar of a stepless retractable handle assembly for luggage in accordance with a second embodiment of the present invention.

It is to be noted that the supplementary anchor clamps 80 can be eliminated from the positioning units 60 according to actual requirements. In this case, as illustrated in FIG. 10, the second pivot pins 79, the third pivot bolts 83 and the fourth pivot bolts 84 can be eliminated from the positioning units 60 and, the third lateral hole 656, the fourth lateral hole 657 and the second longitudinal sliding slot 658 can be eliminated from each movable holder frame 65. The simplified positioning units 60 can still effectively let the inner tubes 32 of the retractable bars 30 be conveniently adjusted to the desired height in a stepless manner and then locked in the adjusted position.

In conclusion, the stepless retractable handle assembly 10 of the present invention is quite convenient in operation. The most important is the ability to meet the needs of different users for adjustment to any desired height without structural limitations, achieving the purpose of increasing user comfort.

What is claimed is:

1. A stepless retractable handle assembly for luggage, comprising:

a handle grip comprising a bottom grip shell and a top grip shell mounted on a top side of said bottom grip shell, said top grip shell comprising a button slot;

two retractable bars, each said retractable bar comprising an outer tube and an inner tube axially slidably inserted into said outer tube, said inner tube having a top end thereof fixedly connected to said bottom grip shell of said handle grip;

a control unit comprising a press-button and a first return device, said press-button being vertically movably mounted in said button slot of said top grip shell of said handle grip, said press-button comprising two first pushing abutment portions located at a bottom side thereof, said first return device being mounted between said bottom grip shell of said handle grip and said press-button;

a transmission unit comprising two transmission plates, two bearing blocks and two connection shafts, said two transmission plates being transversely movably mounted in said bottom grip shell of said handle grip, each said transmission plate comprising two first bearing portions located at one end thereof and respectively abutted against said first pushing abutment portions of said press-button and a second pushing abutment portion located at an opposite end thereof, said two bearing blocks being respectively affixed to respective top ends of said inner tubes of said retractable bars, each said bearing block comprising a second bearing portion abutted against the second pushing abutment portion of one respective said transmission plate, said two connection shafts being respectively inserted into said inner tubes of said retractable bars and respectively connected to respective bottom ends of said bearing blocks; and two positioning units, each said positioning unit comprising an anchor clamp holder, an anchor clamp and a second return device, said anchor clamp holder being mounted in said inner tube of one respective said retractable bar and connected to a bottom end of one respective said connection shaft for movement with said inner tube of one respective said retractable bar relative to the associating said outer tube, said anchor clamp being pivotally connected to said anchor clamp holder and disposed in said outer tube of one respective said retractable bar and movable to frictionally abut against or release from an inside wall of said outer tube of the respective said retractable bar subject to vertical displacement of said anchor clamp holder in the respective said retractable bar, said second return device being stopped against said anchor clamp holder;

wherein said anchor clamp holder comprises a fixed holder frame and a movable holder frame, said fixed holder frame being fixedly fastened to said inner tube of one respective said retractable bar and comprising a first locating hole, said movable holder frame being connected to the bottom end of the respective said connection shaft and comprising a first longitudinal sliding slot; each said positioning unit further comprises a first pivot pin inserted through said first locating hole of the respective said fixed holder frame and said first longitudinal sliding slot of the respective said movable holder frame; said anchor clamp is pivotally connected to a bottom end of the respective said movable holder frame.

2. The stepless retractable handle assembly for luggage as claimed in claim 1, wherein said movable holder frame of said anchor clamp holder comprises a first lateral hole and a second lateral hole; said anchor clamp comprises a first clamping arm and a second clamping arm, said first clamping arm comprising a first transverse guide hole located in one end thereof and a first pivot hole disposed adjacent to said first transverse guide hole, said second clamping arm comprising a second transverse guide hole located in one end thereof and a second pivot hole disposed adjacent to said second transverse guide hole; each said positioning unit further comprises a first pivot bolt and a second pivot bolt, said first pivot bolt being inserted through said first lateral hole of the respective said movable holder frame and said first transverse guide hole of the respective said first clamping arm, said second pivot bolt being inserted through said second lateral hole of the respective said movable holder frame and said second transverse guide hole of the respective said second clamping arm; said first pivot pin is inserted through said first pivot hole of the respective said first clamping arm and said second pivot hole of the respective said second clamping arm.

3. The stepless retractable handle assembly for luggage as claimed in claim 2, wherein said anchor clamp further comprises a first friction member and a second friction member, said first friction member being mounted at an opposite end of the respective said first clamping arm and releasably abutted against the inside wall of said outer tube of the respective said retractable bar, said second friction member being mounted at an opposite end of the respective said second clamping arm and releasably abutted against the inside wall of said outer tube of the respective said retractable bar.

4. The stepless retractable handle assembly for luggage as claimed in claim 2, wherein said first clamping arm comprises a first spring groove extending around said first pivot hole of the respective said first clamping arm; said second clamping arm comprises a second spring groove extending around said second pivot hole of the respective said second clamping arm; said anchor clamp further comprises two torsion springs respectively mounted on two opposite ends of the respective said first pivot pin and respectively accommodated in said first spring groove in said first clamping arm and said second spring groove in said second clamping arm.

5. The stepless retractable handle assembly for luggage as claimed in claim 1, wherein said fixed holder frame further comprises a second locating hole spaced below the associating said first locating hole; said movable holder frame further comprises a second longitudinal sliding slot spaced below the associating said first longitudinal sliding slot; each said positioning unit further comprises a supplementary anchor clamp, said supplementary anchor clamp being pivotally connected the bottom end of the respective said movable holder frame by a respective second pivot pin, said second pivot pin being inserted through said second locating hole of the respective said fixed holder frame and said second longitudinal sliding slot of the respective said movable holder frame.

6. The stepless retractable handle assembly for luggage as claimed in claim 5, wherein said movable holder frame of said anchor clamp holder comprises a first lateral hole, a second lateral hole opposite to said first lateral hole, a third lateral hole spaced below said first lateral hole and a fourth lateral hole spaced below said second lateral hole; said anchor clamp comprises a first clamping arm and a second clamping arm, said first clamping arm comprising a first transverse guide hole located in one end thereof and a first pivot hole disposed adjacent to said first transverse guide hole, said second clamping arm comprising a second transverse guide hole located in one end thereof and a second pivot hole disposed adjacent to said second transverse guide hole; each said positioning unit further comprises a first pivot bolt and a second pivot bolt, said first pivot bolt being inserted through said first lateral hole of the respective said movable holder frame and said first transverse guide hole of the respective said first clamping arm, said second pivot bolt being inserted through said second lateral hole of the respective said movable holder frame and said second transverse guide hole of the respective said second clamping arm; said first pivot pin is inserted through said first pivot hole of the respective said first clamping arm and said second pivot hole of the respective said second clamping arm; said supplementary anchor clamp comprises a third clamping arm and a fourth clamping arm, said third clamping arm comprising a third pivot hole located in one end thereof, said fourth clamping arm comprising a fourth pivot hole located in one end thereof; said second pivot pin is inserted through said third pivot hole of the respective said third clamping arm and said fourth pivot hole of the respective said fourth clamping arm; each said positioning unit further comprises a third pivot bolt and a fourth pivot bolt, said third pivot bolt being inserted through said third lateral hole of the respective said movable holder frame and stopped at the outer perimeter of the respective said third clamping arm, said fourth pivot bolt being inserted through said fourth lateral hole of the respective said movable holder frame and stopped at the outer perimeter of the respective said fourth clamping arm.

7. The stepless retractable handle assembly for luggage as claimed in claim 6, wherein said anchor clamp further comprises a first friction member, a second friction member, a third friction member and a fourth friction member, said first friction member being mounted at an opposite end of the respective said first clamping arm and abutted against the inside wall of said outer tube of the respective said retractable bar, said second friction member being mounted at an opposite end of the respective said second clamping arm and abutted against the inside wall of said outer tube of the respective said retractable bar, said third friction member being mounted at an opposite end of the respective said third clamping arm and abutted against the inside wall of said outer tube of the respective said retractable bar, said fourth friction member being mounted at an opposite end of the respective said fourth clamping arm and abutted against the inside wall of said outer tube of the respective said retractable bar.

8. The stepless retractable handle assembly for luggage as claimed in claim 7, wherein said first clamping arm comprises a first spring groove extending around said first pivot hole of the respective said first clamping arm; said second clamping arm comprises a second spring groove extending around said second pivot hole of the respective said second clamping arm; said third clamping arm comprises a third spring groove extending around said third pivot hole of the respective said third clamping arm; said fourth clamping arm comprises a fourth spring groove extending around said fourth pivot hole of the respective said fourth clamping arm; said anchor clamp further comprises four torsion springs, two said torsion springs being respectively mounted on two opposite ends of the respective said first pivot pin and respectively accommodated in said first spring groove in the respective said first clamping arm and said second spring groove in the respective said second clamping arm, the other said torsion springs being respectively mounted on two opposite ends of the respective said second pivot pin and respectively accommodated in said third spring groove in the respective said third clamping arm and said fourth spring groove in the respective said fourth clamping arm.

9. The stepless retractable handle assembly for luggage as claimed in claim 1, wherein said fixed holder frame of said anchor clamp holder comprises a lower bearing wall; said movable holder frame comprises an upper bearing wall; said second return device of each said positioning unit is mounted between said lower bearing wall of the respective said fixed holder frame and said upper bearing wall of the respective said movable holder frame.

* * * * *